United States Patent [19]

Chappell, Jr. et al.

[11] Patent Number: 4,519,097

[45] Date of Patent: May 28, 1985

[54] VIDEO GAME PROTECTIVE GLOVE

[76] Inventors: Johnny L. Chappell, Jr., 5433 Colfax Ave. South, Minneapolis, Minn. 55419; Charles Johnson, 30 W. 93rd St., No. 204A, Bloomington, Minn. 55420

[21] Appl. No.: 482,866

[22] Filed: Apr. 7, 1983

[51] Int. Cl.[3] ..... A41D 13/10

[52] U.S. Cl. ..... 2/16; 2/161 A; 2/163; 2/159

[58] Field of Search ..... 2/16, 19, 20, 161 A, 2/159

[56] References Cited

U.S. PATENT DOCUMENTS

| | | | |
|---|---|---|---|
| 360,135 | 3/1887 | Blomstrom | 2/19 |
| 651,701 | 6/1900 | Delamere | 2/159 |
| 1,954,262 | 4/1934 | Potter | 2/161 A |
| 2,092,318 | 9/1937 | Lindfelt | 2/159 |
| 2,270,882 | 1/1942 | Link | 2/159 |
| 2,447,328 | 8/1948 | Gerrits | 2/161 A |
| 2,700,159 | 1/1955 | Van Denburgh | 2/161 A |
| 3,387,306 | 6/1968 | Korey | 2/159 |
| 3,411,159 | 11/1968 | Berkhemer | 2/159 |
| 4,103,362 | 8/1978 | Blakeman | 2/161 A |
| 4,408,358 | 10/1983 | Swan | 2/161 A |

*Primary Examiner*—Werner H. Schroeder
*Assistant Examiner*—T. G. Graveline
*Attorney, Agent, or Firm*—Alan G. Greenberg

[57] ABSTRACT

This invention relates to a protective glove for players of video games which is adjustable with VELCRO hook and loop fasteners to fit various size hands. Protective fingers are employed which leave the fingertips of the player exposed for greater sensitivity and feel of the controls while protecting the user's fingers from abrasions, calluses and bruises. A means for ventilating the glove is provided in the form of an opening which allows air circulation while giving the dual purpose good sensitivity to the control of the game.

2 Claims, 3 Drawing Figures

VIDEO GAME PROTECTIVE GLOVE

This invention relates to a protective glove for players of video arcade games. In recent years, video arcade games have become very popular. Skilled players have playing sessions which extend for many hours. During such play, the participant's hand which operates the controls, is subjected to abrasion from rough panel surfaces or constant contact and pressure from controls. Because of the sensitivity of these video games and the delicate control which must be employed to be a skillful player, a protective glove must allow for free movement of the hand at the wrist and for sensitive touch and feel of the fingers.

There are protective gloves available particular to a special endeavor or sport, but for the reasons set forth above and hereinafter, these earlier gloves do not meet the requirements of a video game affecianado. The athletic glove of Stansberry, et al., No. 3,501,773, does not give the freedom of movement taught by this invention nor the ventilation. Once again, De Marco, No. 4,183,100, shows a glove immobilizing or restricting the freedom of wrist movement, and makes no provision for ventilation while providing inadequate protection for a video game player. In Potter, No. 1,915,617, the glove is to protect the wrist and back of the player's hand. The prior art devices are concerned with the palm of the hand, i.e., better grip or positioning of a piece of sporting apparatus rather than protecting against abrasion while maintaining finger sensitivity as taught herein.

Referring to the drawings.

Figure 1:
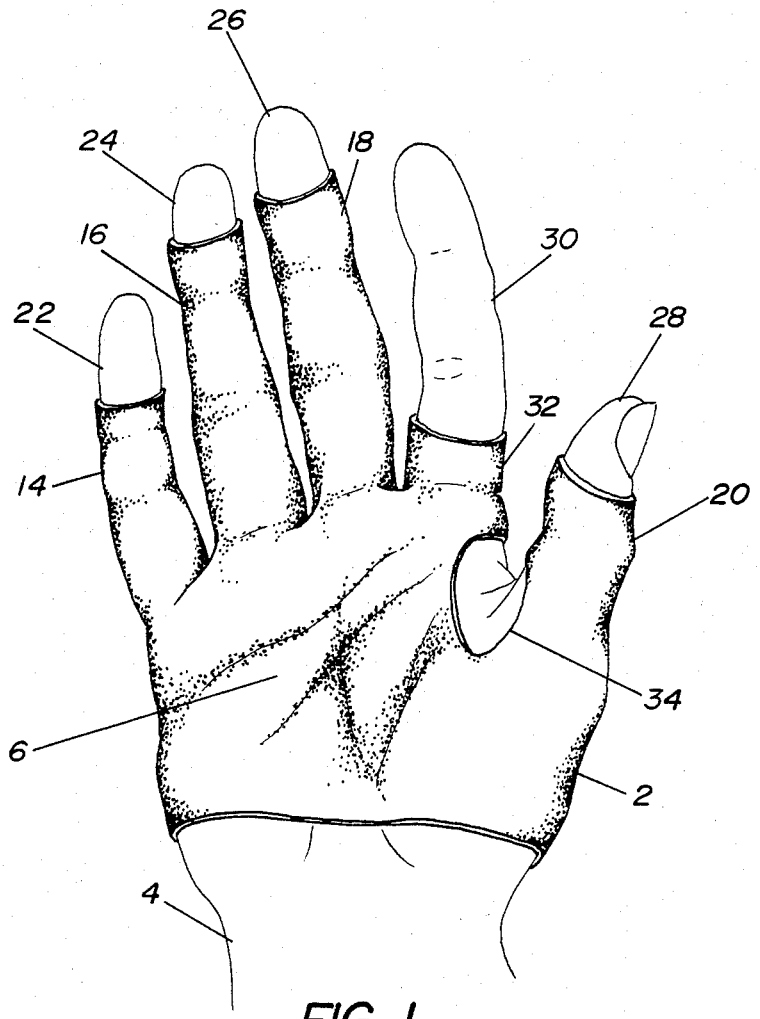
FIG. 1 is a pictorial view of the protective glove on a hand as seen from the palm side.
Figure 2:
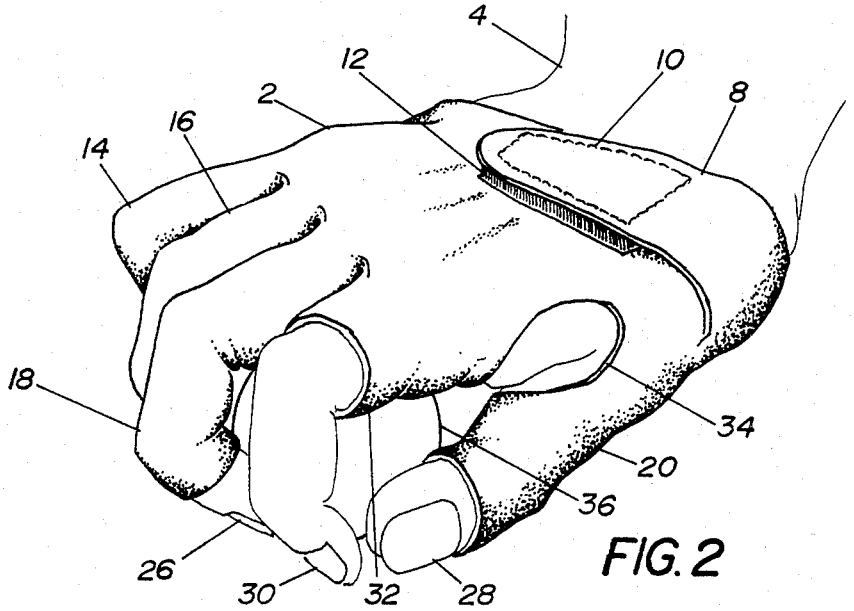
FIG. 2 is a pictorial view of the glove on a hand as positioned to grip a control on a video game; and, FIG. 3 is a pictorial view of the glove on a hand as seen from the back of the hand with the fastening means open.
Figure 3:
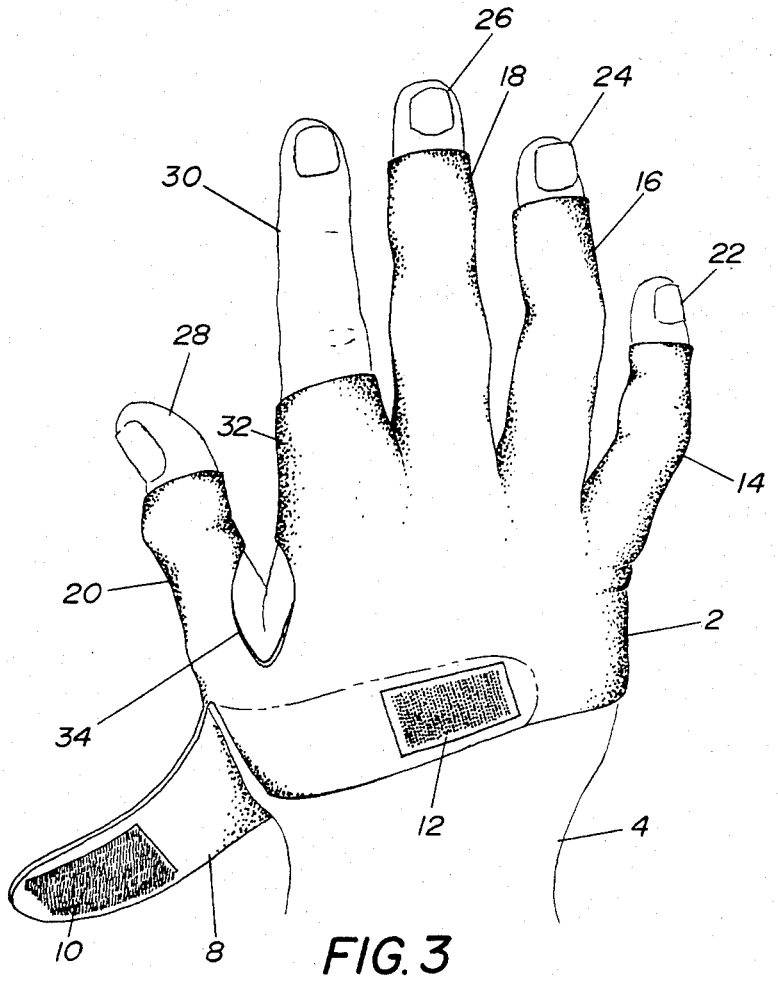

The glove 2 is formed to be short so that the user's wrist 4 is free and unfettered. The glove palm 6, however, is designed to be snug. To assure a snug fit on palm 6 and to provide a glove which fits a variety of hand sizes, an adjustable means is provided. Such an adjustable means may take the form of a first part of the glove body and a second part of the glove body, the said second part being adapted to overlap said first part and to be selectively, releasably secured to said first part. Such adjustable means is adequately demonstrated by said second part of the glove body comprising a flap 8. A VELCRO hook and loop fastener 10 is suitably depicted secured to flap 8. Said first part of glove body is shown as the back of glove 2. A mating VELCRO hook and loop member 12 is secured to said first part of glove body and adapted to mate with VELCRO hook and loop fastener 10 to secure flap 8 in the desired position.

Protective fingers are provided secured to glove 2 in order to protect the wearer's finger from abrasions, calluses and bruises while maintaining sensitivity of touch for operating the game controls. Such protective fingers are suitably demonstrated by open-ended tubes 14, 16, 18 and 20, secured to glove 2, which fingers open after covering the distal knuckles on little finger 22, ring finger 24, middle finger 26 and thumb 28 so as to expose the fingertips to achieve touch sensitivity for the user.

Because the user's forefinger 30 is more involved in the operation and control of the video game, it must be given greater freedom than the other digits. Thus, glove finger 32 is shorter than the other, extending only approximately one-half the distance of the proximal phalanx of the forefinger.

A skilled video game player will use a video game for extended time periods during which the tension and excitement of the game will cause temperature increase and perspiration To avoid severe heat and perspiration discomfort with glove 2, ventilation means are provided. Such ventilation means are demonstrated by opening 34 between glove thumb 20 and glove forefinger 32. Opening 34 should be of such size to provide sufficient air cooling while allowing the operator to have a sensitive feel of a video game control 36.

It will be appreciated that the user of the protective glove of this invention will be able to protect the hand and fingers from abrasion, calluses and bruises which are normally associated with proficient players of video games, while maintaining unfettered sensitivity for the game controls.

We claim:

1. A protective glove comprising: a glove body, an adjustable means for securing the glove on a user's hand, while adapting the glove for various hand sizes, said adjustable means adapted to leave the user's wrist unfettered and said adjustable means comprising VELCRO hook and loop fasteners; protective fingers at the little finger, ring finger and thumb positions comprising an open-ended tube from the glove body to cover the distal knuckle on these fingers while leaving the fingertips of the user's hand uncovered for better sensitivity of touch; a shorter protective finger at the forefinger position extending from the glove body to approximately one-half the distance of the proximal phalanx of the forefinger to allow greater sensitivity and freedom for the forefinger of the user's hand; and, ventilation means comprising a relatively large opening between the thumb and forefinger covers on said glove and adapted to prevent the user's hand from perspiring while providing the hand with sensitive feel of a video game control.

2. A protective glove for video game usage comprising: a glove body adapted to selectively adapt the glove to fit various size hands of a user by size adjusting means while leaving gthe user's wrist motion unimpaired, said size adjusting means comprising: a first part of the glove body and a second part of the glove body, said second part adapted to overlap said first part and cooperating connecting means secured to both said first part and said second part to selectively, releasably and adjustably secure said second part to said first part, said connecting means comprising a VELCRO hook and loop fastener; finger protecting means operably secured to said glove body and adapted to protect the user's fingers from abrasion while providing the user with a sensitive touch; said finger protecting means comprising fingers secured to the gloove body to cover the little finger, ring finger, middle finger and thumb to cover the distal knuckle on each of these fingers while leaving the fingertip open for greater sensitivity and agility and to cover the forefinger to midproximal phalanx to leave this digit unfettered for better control of the game by the wearer; and, a ventilating means adapted to allow air to circulate to the user's hand to prevent perspiration during long playing sessions while maintaining sensitivity to the game control, said ventilating means comprising a relatively large opening between said thumb and forefinger covers.

* * * * *